US007117698B2

(12) United States Patent
Lai

(10) Patent No.: US 7,117,698 B2
(45) Date of Patent: Oct. 10, 2006

(54) HIGH SECURITY PADLOCK CONSTRUCTION

(75) Inventor: Eric Lai, Tai Po (HK)

(73) Assignee: The Sun Lock Company Ltd., Hong Kong (HK)

( * ) Notice: Subject to any disclaimer, the term of this patent is extended or adjusted under 35 U.S.C. 154(b) by 0 days.

(21) Appl. No.: 11/189,178

(22) Filed: Jul. 25, 2005

(65) Prior Publication Data

US 2006/0027001 A1 Feb. 9, 2006

Related U.S. Application Data

(60) Provisional application No. 60/598,719, filed on Aug. 3, 2004.

(51) Int. Cl.
*E05B 37/02* (2006.01)
*E05B 67/24* (2006.01)

(52) U.S. Cl. ..... 70/21; 70/25; 70/38 A; 70/312

(58) Field of Classification Search ..... 70/21, 70/22, 24–26, 284, 285, 38 A, 386, DIG. 71, 70/DIG. 63, 30, 312
See application file for complete search history.

(56) References Cited

U.S. PATENT DOCUMENTS

| | | | | | |
|---|---|---|---|---|---|
| 3,720,082 | A * | 3/1973 | Feinberg et al. | ..... | 70/25 |
| 5,125,248 | A * | 6/1992 | Ling | ..... | 70/25 |
| 5,953,940 | A * | 9/1999 | Ling | ..... | 70/25 |
| 6,029,481 | A * | 2/2000 | Lai | ..... | 70/25 |
| 6,176,109 | B1 * | 1/2001 | Tsui | ..... | 70/25 |
| 6,363,758 | B1 * | 4/2002 | Ling | ..... | 70/30 |
| 6,470,718 | B1 * | 10/2002 | Yang | ..... | 70/30 |
| 6,474,116 | B1 * | 11/2002 | Lai | ..... | 70/25 |
| 6,729,166 | B1 * | 5/2004 | Lai | ..... | 70/25 |

* cited by examiner

*Primary Examiner*—Lloyd A. Gall
(74) *Attorney, Agent, or Firm*—Melvin I. Stoltz

(57) ABSTRACT

By providing a unique cam member which cooperatingly controls shackle locking elements to move between a first locked position and a second unlocked position, an effective, easily produced, high security padlock is achieved. Furthermore, the high security padlock of the present invention is constructed, in one embodiment, for being controlled by use of a combination system and, in an alternate embodiment, for being controlled by using either a combination system or a key and tumbler system.

20 Claims, 7 Drawing Sheets

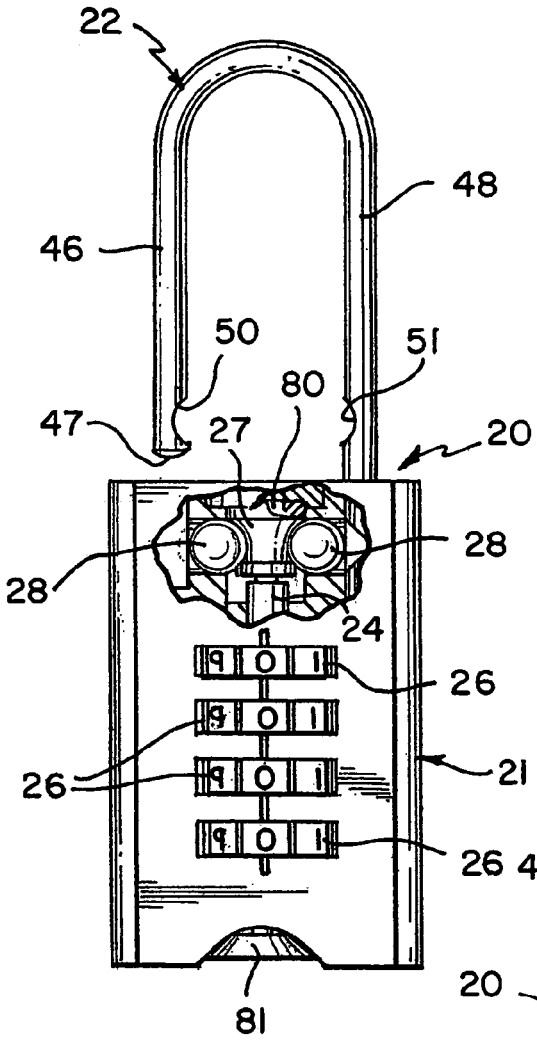
FIG. 4
FIG. 5
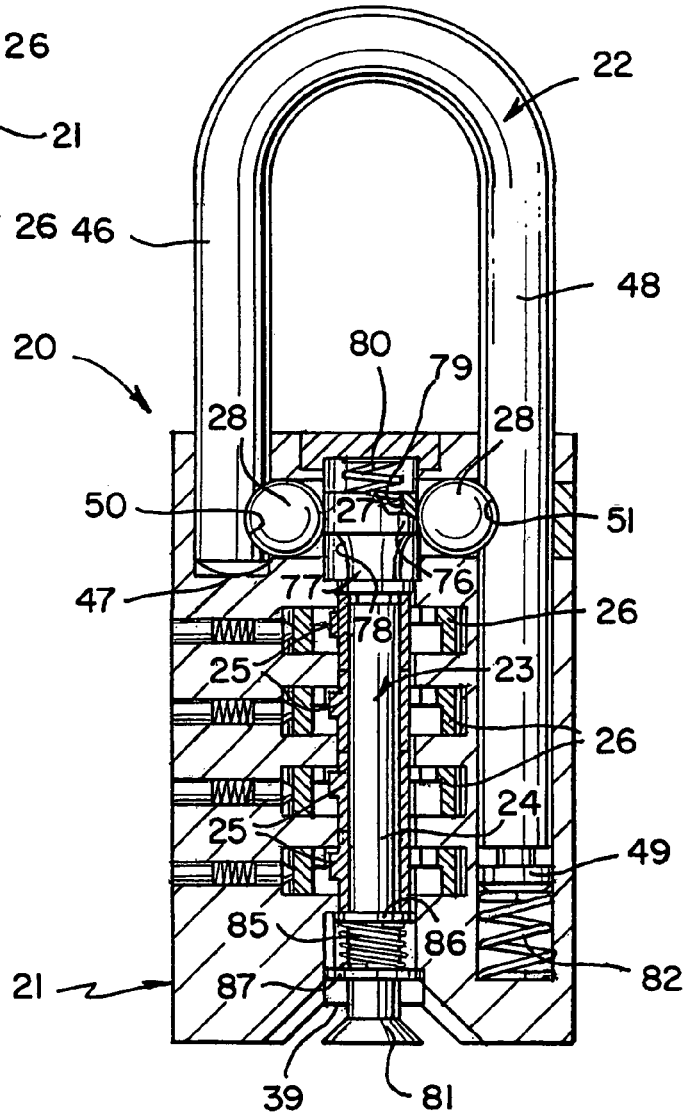

FIG. 6A
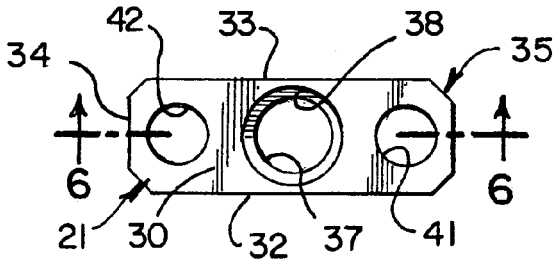
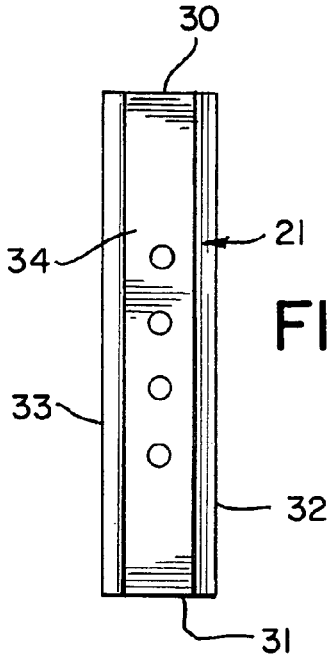
FIG. 6B
FIG. 6C
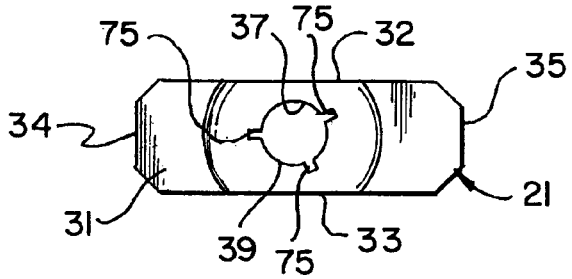
FIG. 6
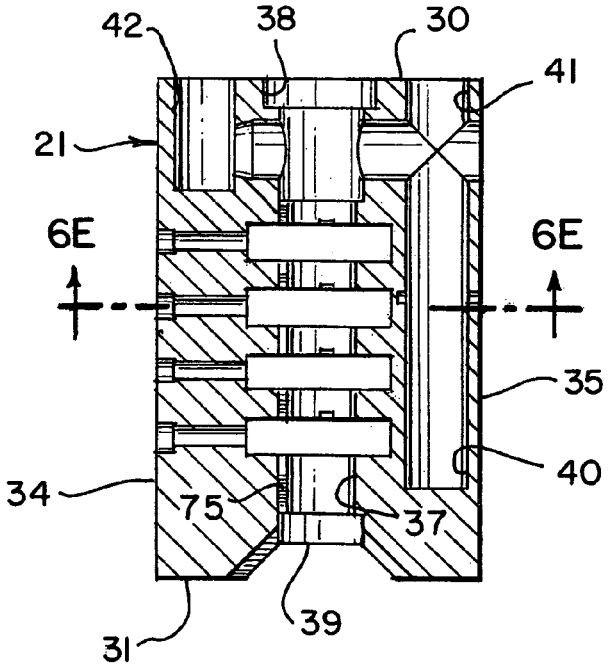
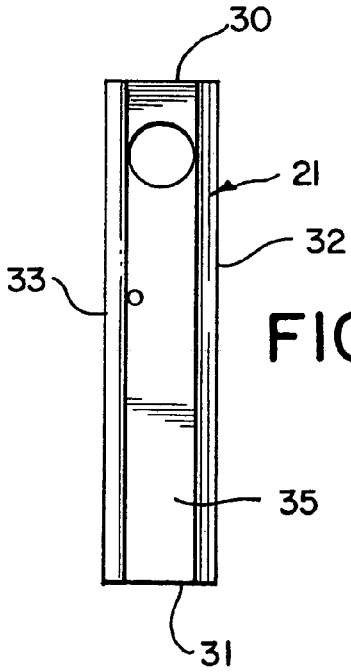
FIG. 6D
FIG. 6E
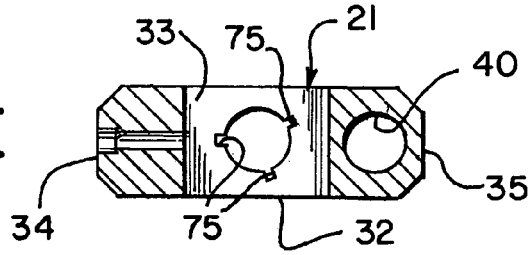

FIG. 7
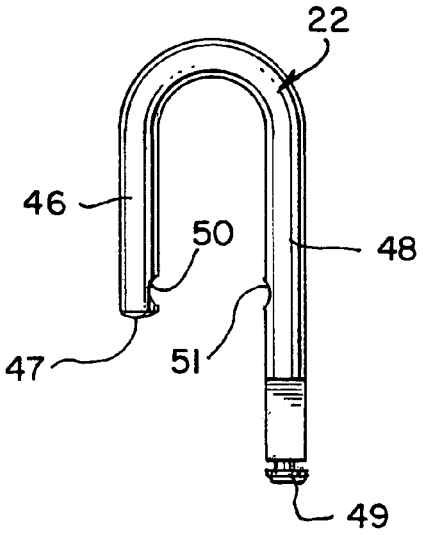
FIG. 7A
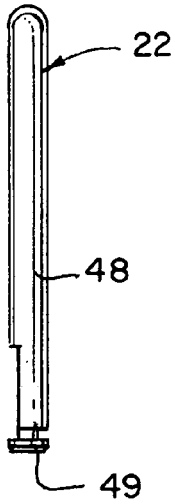
FIG. 8
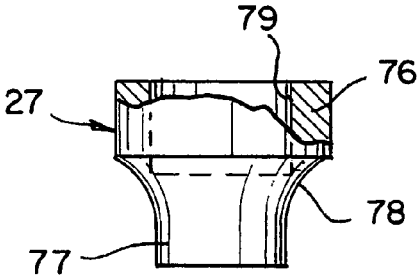
FIG. 9
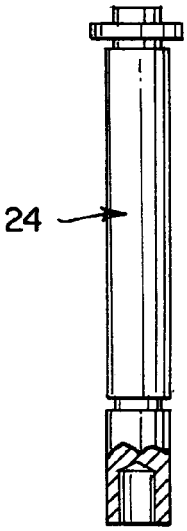
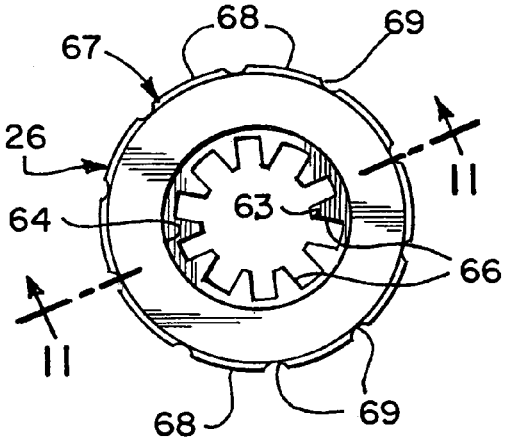
FIG. 10
FIG. 11
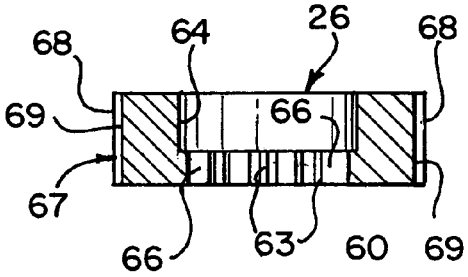
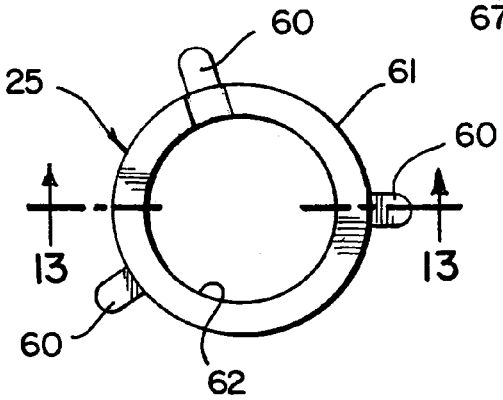
FIG. 12

FIG. 13
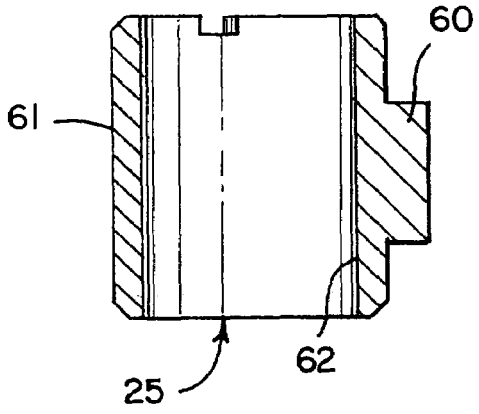
FIG. 14
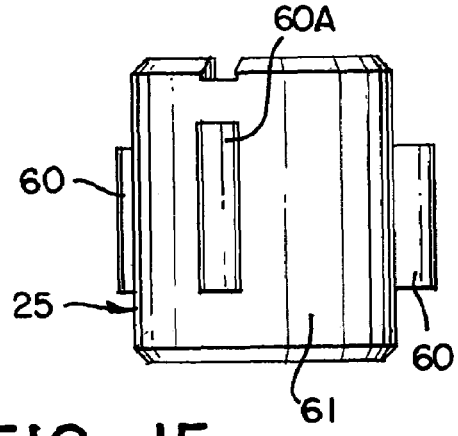
FIG. 15
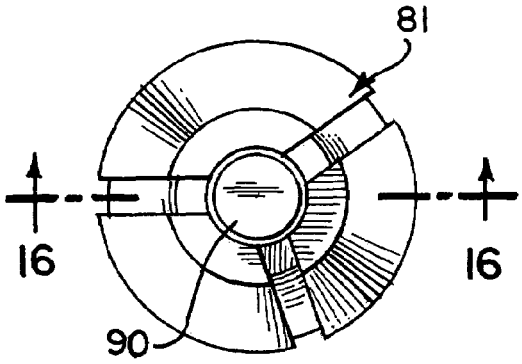
FIG. 16
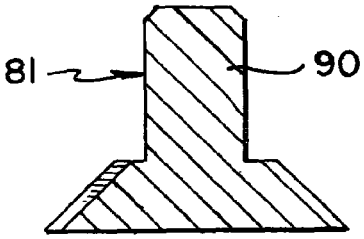
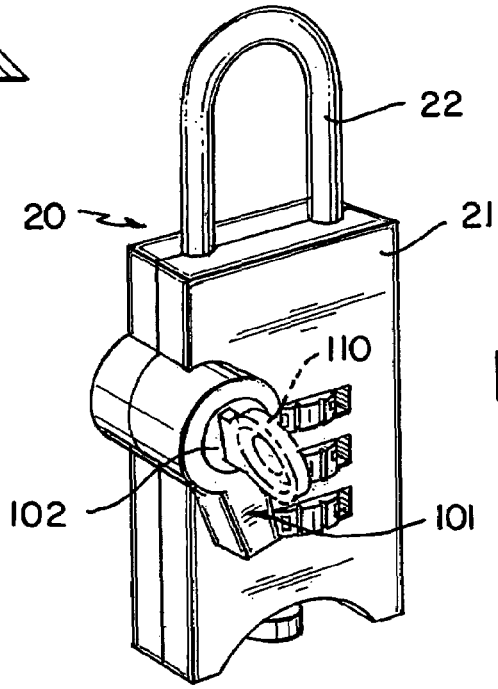
FIG. 17

HIGH SECURITY PADLOCK CONSTRUCTION

RELATED APPLICATIONS

This application is related to U.S. Provisional Patent Application Ser. No. 60/598,719, filed Aug. 3, 2004 entitled RESETTABLE COMBINATION PADLOCK WITH DEADBOLT LOCKING MECHANISM.

TECHNICAL FIELD

This invention relates to padlocks and, more particularly, to combination padlocks constructed for use in high integrity, secure applications.

BACKGROUND ART

Numerous lock constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular, due to it ease and convenience of use, is a combination lock which employs a plurality of rotatable independent dials, each of which comprises a plurality of indicia, usually numbers or letters, which define the combination for releasing the lock. Although locks of this general nature had been available for several decades, these prior art combination lock constructions are typically employed in low security areas, due to their inability to resist forced entries in which excessive force is applied to the lock.

In those areas wherein a high security lock system is required, prior art constructions have relied upon padlocks which require a key for operating the lock between its alternate open position and closed position. Due to the ease with which keys are often lost or misplaced, as well as the proliferation of the keys required for many individuals to carry, high security padlocks requiring keys for operation has become increasingly unpopular. However, prior art constructions have been incapable of providing a high security padlock incorporating a combination system for operating the padlock, either independently or in combination with a key.

In addition to prior art, high security padlock constructions relying upon key activation and operation, another problem which has consistently plagued prior art constructions is the cost of construction for producing and assembling prior art padlocks. In order to attain a padlock which provides all of the features desired by the users, prior art constructions typically incorporate numerous small components, each of which require inexpensive assembly procedures to produce the final product. As a result, these prior art high security padlock constructions are typically expensive to produce, thereby reducing the ability of these padlocks to reach a broader base of users.

Another problem commonly found with prior art high security padlocks is the inability of these prior art constructions to prevent contaminants from reaching the internal components of the padlock, thereby causing damage to these components and interfering with the ease of operation of the padlock by authorized personnel. Although numerous attempts have been made to reduce the adverse effect caused by contaminants reaching these components, such attempts have been incapable of satisfactorily eliminating this problem.

A further problem commonly found in prior art high security padlocks is the ability of these locks to be opened by unauthorized individuals using known picking techniques. In particular, since most prior art products employ keys for their operation, unauthorized entry is a common problem.

Therefore, it is a principal object of the present invention to provide a padlock construction which is specifically designed for effective operation in high security applications and is operable using a combination system, either independently or in combination with a key system.

Another object of the present invention is to provide a padlock construction having the characteristic features described above which virtually eliminates the ability of unauthorized persons from gaining access to the lock by attempting to pick the lock using known techniques.

Another object of the present invention is to provide a padlock construction having the characteristic features described above which employs a minimum of components and is quickly and easily assembled, thereby providing a lock capable of being constructed at a competitive price.

Another object to the present invention is to provide a padlock having the characteristic features described above which effectively seals the rotating components from external contamination and effectively prevents any external contaminants from reaching the rotating components and thereof.

Other and more specific object will in part be obvious and will in part appear hereinafter.

SUMMARY OF THE INVENTION

By employing the present invention, all of the difficulties and drawbacks of the prior art constructions are fully eliminated and an effective, easily produced, high security padlock is achieved which employs, in one embodiment, a combination system for fully operating the padlock and a combined combination and key in an alternate embodiment. Furthermore, the high security, padlock of the present invention virtually eliminates the ability of unauthorized persons from opening the padlock using known picking techniques.

In addition, the padlock construction of the present invention is designed with the interior chambers thereof virtually sealed from ambient surroundings, thereby preventing unwanted contamination from entering the interior of the lock and/or the rotating components thereof. In this way, the prior art degradation and interference of the lock operation by contamination is virtually eliminated.

In accordance with the present invention, a minimum number of components are employed in combination with a housing, a shackle member, and an elongated, combination controlled movable locking shaft or rod, which is constructed for longitudinal movement only when the desired, preselected combination is effectively entered on the padlock. By employing a minimum number of components in the construction of the high integrity, secure, combination padlock of the present invention, a highly efficient and cost-effective product is realized.

In an alternate embodiment of the present invention, the high security padlock is able to be opened by employing either a combination system or a key system. In this way, the advantages of both a combination and a key are available to the user.

In order to assure the creation of a secure, tamper resistant padlock construction, the present invention incorporates a uniquely constructed cam member in combination with a plurality of steel, spherically shaped balls or bearings which control the movement of the shackle between its open/unlocked position and its closed/locked position. In addition, the movement of these components is completely dependent upon the axial movement of the combination controlled locking shaft or rod or the movement of the cam member by a key controlled system.

In the present invention, rotatable dials are employed to enable any desired combination to be selected and employed for opening the padlock. However, in the preferred embodiment of the present invention, the rotatable dials are mounted in receiving zones formed in a central zone of the housing, thereby being peripherally surrounded by the housing structure. In this way, access to the rotatable dials is limited to enable users to easily rotate the dials, while preventing any unauthorized individuals from being able to exert excessive force on the dials in attempting to gain forced entry.

In addition, in the preferred construction, the padlock of the present invention is constructed from heavy-duty metal, such as brass, stainless steel, hardened steel, and the like, with an enlarged, heavy-duty shackle being employed for providing the desired securement. In addition to providing the use of heavy-duty, strong, tamper-resistant materials, the present invention also employs a tamper-proof holding cavity for the combination controlled locking rod or shaft, thereby preventing unwanted access thereto.

Another feature incorporated into the padlock of the present invention is a unique tumbler or clutch wheel construction which cooperates with the rotating dials to virtually eliminate any possibility that an unauthorized person would be capable of gaining access to the padlock by known combination lock picking techniques. In this unique construction, each tumbler or clutch wheel is constructed with a plurality of radially extending fins formed thereon, with each of the fins being arcuately spaced from the adjacent fin in a non-symmetrical pattern. This non-symmetrical spacing is most easily achieved by having each of the fins arcuately spaced from each adjacent fin by unequal radial distances.

As a result of this construction, in addition to being required to attempt to determine the correct position for each of the rotating dials, an unauthorized individual attempting to use known picking techniques would be required to align each tumbler or clutch wheel in a single correct position while hearing a plurality of "clicks" as each fin aligns with a receiving cavity formed in the housing, even when the other fins are not properly aligned. In this way, numerous false and mis-leading sounds are produced, causing any individual to be completely frustrated and unable to open the padlock of the present invention.

A further feature incorporated into the padlock of the present invention is a break-away handle or knob mounted to the activating shaft or rod. In the preferred construction, the tumblers or clutch wheels and dials are mounted about a shaft which is axially movable only when the correct combination has been entered on the dials. In order to enable a user to operate the shaft, a handle or knob is mounted on one end of the shaft/rod.

In normal use, the handle or knob is employed to axially move the shaft/rod in order to unlock the shackle. For this purpose, the handle/knob is secured to the shaft. However, if an unauthorized individual attempts to open the padlock by force and, in exerting this force, applies excessive pressure to the handle/kob in an attempt to forceably move the shaft, the break-away feature of the handle/knob causes the handle/knob to be separated from the shaft, leaving a slippery, no-grip metal end. Once separated, the handle/knob cannot be attached to the shaft and the attempt to forceably open the padlock will have failed with no further means being available to the unauthorized person.

The invention accordingly comprises an article of manufacture possessing the features, properties, and the relations of elements which are exemplified in the article described herein and the scope of the invention will be indicated in the claims.

THE DRAWINGS

For a fuller understanding of the nature and objects of the invention, reference should be had to the following detailed description taken in connection with the accompanying drawings, in which:

FIG. 4 is a rear view, partially broken away, of the combination padlock of FIG. 1, shown in its unlocked position;

FIG. 5 is a cross-sectional front elevation view of the combination padlock of FIG. 1 shown in its locked position;

FIG. 6 is a cross-sectional front elevation view of the housing employed in the combination padlock of FIG. 1;

FIG. 6A is a top plan view of the housing of FIG. 6;

FIG. 6B is a left side elevation view of the housing of FIG. 6;

FIG. 6C is a bottom plan view of the housing of FIG. 6;

FIG. 6D is a right side elevation view of the housing of FIG. 6;

FIG. 6E is a cross-sectional plan view taken a long line 6E-6E of FIG. 6;

FIG. 7 is a front elevation view of the shackle employed in the combination padlock of FIG. 1;

FIG. 7A is a right side elevation view of the shackle of FIG. 7;

FIG. 8 is a side elevation view of the cam member employed in the combination padlock of the present invention;

FIG. 9 is a side elevation view, partially in cross-section, of the shaft/rod employed in the combination padlock of the present invention;

FIG. 10 is a top plan view of the rotatable dial employed in the combination padlock of the present invention;

FIG. 11 is a cross-sectional side elevation view of the dial of FIG. 10;

FIG. 12 is a top plan view of a clutch wheel/tumbler employed in the combination padlock of the present invention;

FIG. 13 is a cross-sectional side elevation view of the clutch wheel/tumbler of FIG. 12;

FIG. 14 is a side elevation view of the preferred embodiment of clutch wheel/tumbler of FIG. 12;

FIG. 15 is a top plan view of the pushbutton employed in the combination padlock of FIG. 1;

FIG. 16 is a cross-sectional side elevation view of the pushbutton of FIG. 15;

FIG. 17 is a perspective view of a second embodiment of the padlock of the present invention, shown as a padlock in its locked position and incorporating two alternate lock controlling modes;

DETAILED DESCRIPTION

Figure 3:
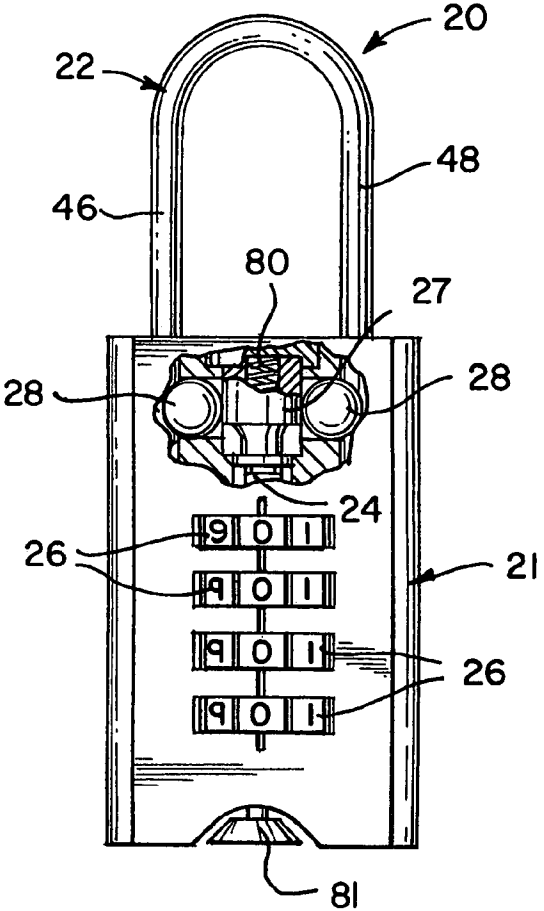
FIG. 3 is a rear elevation view, partially broken away, of the combination padlock of FIG. 1, shown in the locked position.
Figure 2:
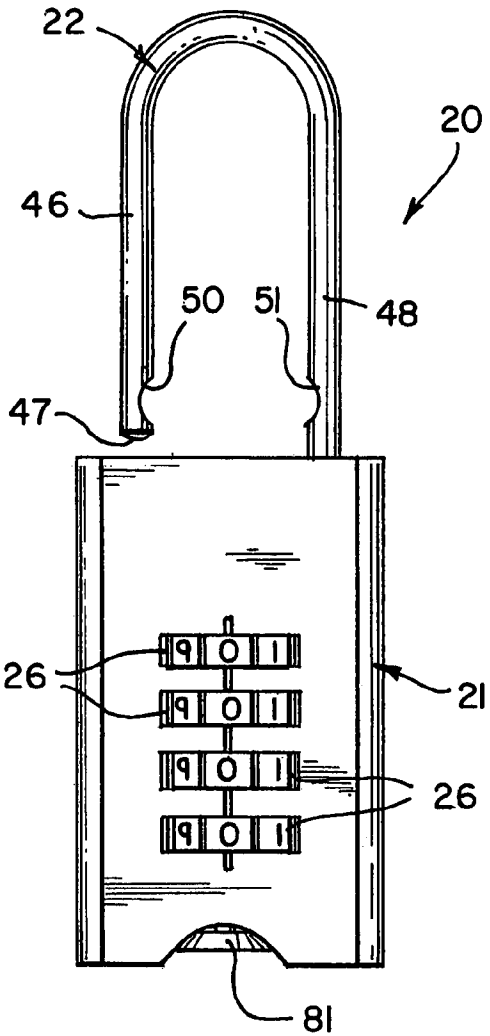
FIG. 2 is a front elevation view of the combination padlock of FIG. 1, shown in its unlocked position.
Figure 1:
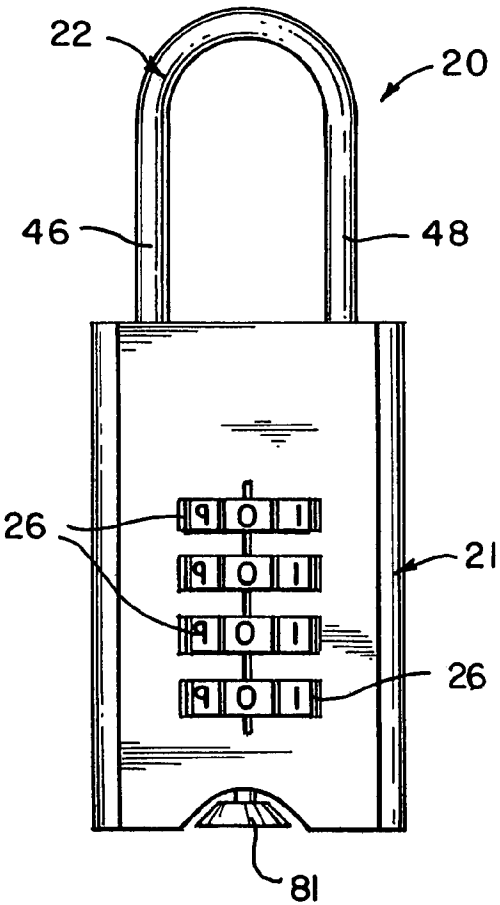
FIG. 1 is a front elevation view of one embodiment of the padlock of the present invention, shown as a combination padlock in its locked position.
Figure 18:
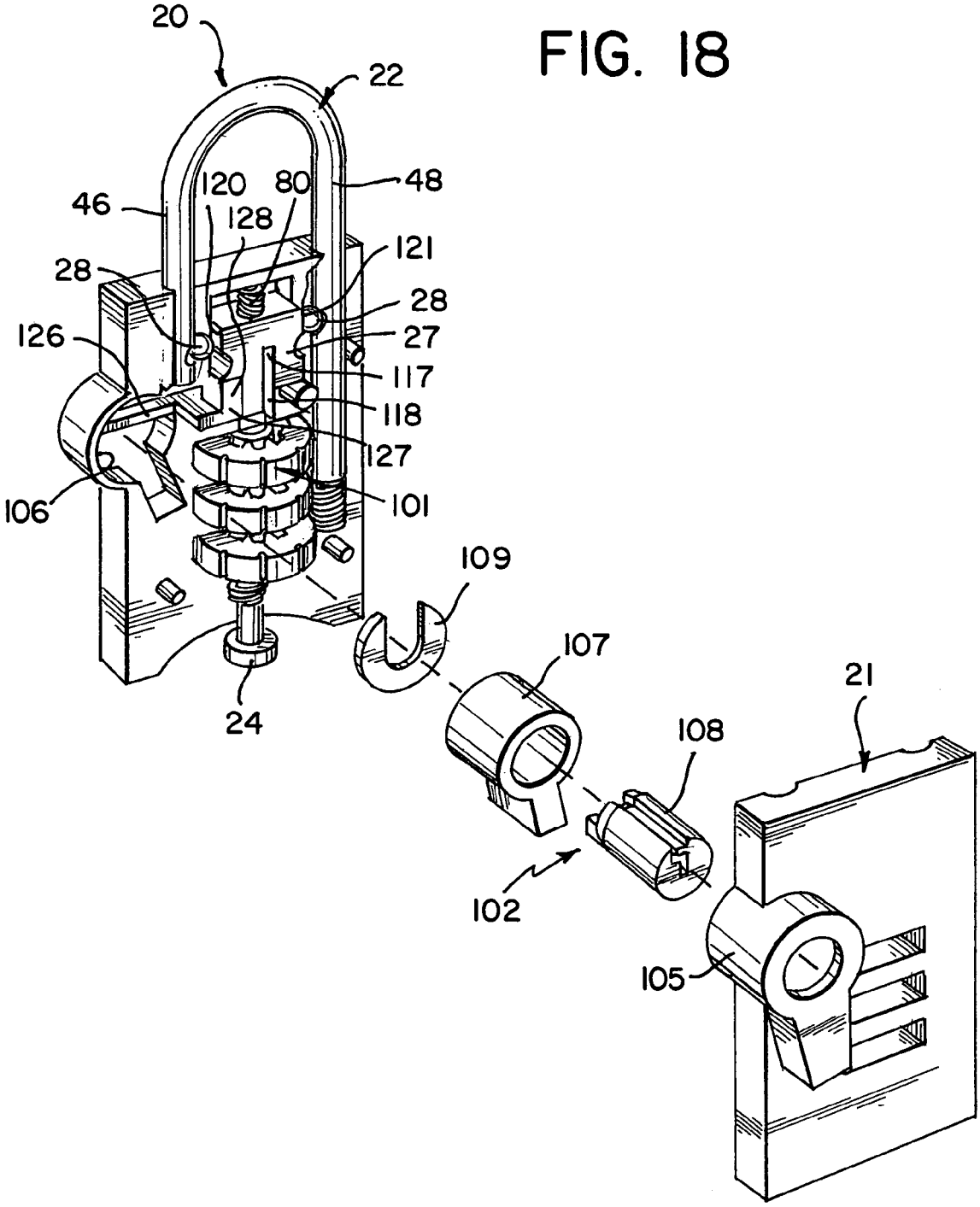
FIG. 18 is an exploded perspective view of the dual locking mode padlock of FIG. 17.

By referring to FIGS. 1–20, along with the following detailed disclosure, the construction and operation of high security padlock 20 of the present invention can best be understood. In the drawings and in the following detailed disclosure, two alternate preferred embodiments of the present invention are fully disclosed. However, the present invention can be implemented using further alternate constructions, all of which are intended to be within the scope of the present invention. Consequently, it should be understood that the embodiments disclosed herein and shown in the drawings are provided for exemplary purposes only and are not intended as a limitation of the present invention.

As best seen in the FIGS. 1–5, one preferred embodiment of the present invention is depicted as fully assembled, high security combination padlock 20. In this embodiment, padlock 20 incorporates a minimum number of principal components, thereby substantially reducing the complexity found in most prior art combination padlocks. In addition, the construction depicted for this embodiment of the present invention provides a secure, tamper-resistant product capable of satisfying high security needs. In this way, the present invention provides a highly effective, commercially desirable construction, capable of being produced at competitive costs, while still providing all of the locking and theft deterrent features typically found in prior art constructions, as well as sought by consumers and not found in prior art constructions.

As clearly depicted in the FIGS. 1–5, the principal components forming this embodiment of high security padlock 20 comprise housing or body 21, shackle 22, and locking/unlocking control assembly 23. In the preferred construction, locking/unlocking control assembly 23 comprises an axially movable shaft or rod 24, a plurality of separate and independent rotatable dials 26, controllably associated with tumbler/clutch wheels 25, cam member 27 and shackle locking members or steel balls/bearings 28, 28. As detailed below, steel balls/bearings 28 are constructed for locking and unlocking controlled engagement with shackle 22. By employing these principal components, in the unique manner detailed herein, any easily produced, highly effective, high security combination padlock 20 is realized.

One of the principal elements of the present invention is shackle 22. In this preferred embodiment, shackle 22 comprises a conventional J-shape incorporating a short leg 46 with a terminating end 47 and a long leg 48 with terminating end 49. In addition, short leg 46 incorporates notched zone 50 formed therein directly adjacent terminating end 47. Similarly, long leg 48 also incorporates a notched zone 51 formed along the length thereof, and positioned in juxtaposed, spaced, facing relationship with notched zone 50. As fully detailed below, notched zones 50 and 51 cooperate with steel balls/bearings 28, 28 and cam member 27 for providing the desired locking and unlocking controlled engagement of shackle 22 with housing 21.

In the present invention, housing or body 21 preferably comprises a one-piece construction, which is formed from heavy-duty metal, such as brass, stainless steel, hardened steel and the like. In the preferred embodiment, as fully depicted in FIGS. 6–6E, housing/body 21 comprises an enlarged, heavy-duty construction which incorporates a plurality of bores, cavities, and receiving zones formed therein. In general, housing 21 comprises top surface 30, bottom surface 31, front panel 32, rear panel 33, and two side edges 34 and 35. In addition, housing 21 also incorporates central, elongated bore 37 which extends through housing 21 from top surface 30 to bottom surface 31. In this regard, bore 37 comprises a first portal 38 formed with top surface 30 of housing 21 and a second portal 39 formed with bottom surface 31 of housing 21. As is more fully detailed below, central bore 37 is constructed for receiving and retaining shaft/rod 24 and enabling shaft/rod 24 to be moved axially, when desired, for controlling the locking and unlocking of combination padlock 20. In the preferred constructions, once all of the components are mounted in central bore 37, the top entry portal is sealed, leaving bore 37 opened at only the base of housing 21.

In addition to central bore 37, housing 21 also incorporates elongated bore 40 formed in housing 21 extending from top surface 30 towards bottom surface 31. In the preferred construction, elongated bore 40 is formed in housing 21 substantially parallel to central bore 37, forming a shackle shaft receiving portal 41 with top surface 30, while terminating prior to reaching bottom surface 31. In the preferred construction, elongated bore 40 is dimensioned for receiving and retaining long leg 48 of shackle 22.

Furthermore, housing 21 also incorporates shackle end receiving hole 42 formed in top surface 30 of housing 21, with hole 42 being formed in juxtaposed, spaced, parallel aligned relationship with central bore 37 and elongated bore 40. Hole 42 is constructed for receiving short leg 46 of shackle 22, providing the desired receiving zone for terminating end 47, whenever combination padlock 20 is in its secured and locked position. As with conventional constructions, hole 42 is constructed with a diameter slightly greater than the diameter of short leg 46 of shackle 22 in order to assure ease of insertion and withdrawal of leg 46 from hole 42.

Housing 21 also incorporates centrally positioned slots or cavities formed therein, positioned in juxtaposed, spaced, parallel relationship with each other, with each of the slots intersecting central bore 37. In this way, receiving zones are formed directly in housing 21 for receiving and retaining dials 26 in a centrally disposed position. By employing this construction a user is able to easily arcuately rotate dials 26, in order to position dials 26 to achieve the preset combination, while also positioning dials 26 in a location which substantially increases the difficulty for unauthorized individuals to attempt to forcibly rotate dials 26.

In this preferred embodiment of the present invention, shaft/rod 24 is positioned in elongated central bore 37 for longitudinal movement therein in order to control the locking and unlocking of combination padlock 20. In this regard, shaft/rod 24 incorporates a plurality of clutch wheels/tumblers 25 rotationally mounted thereto, with clutch wheels/tumblers cooperatively associated with one dial 26.

As shown in FIGS. 5, 12, and 13, each clutch wheel/tumbler 25 comprises a generally cylindrical shape incorporating at least one locking fin 60 radially extending from outer, circular-shaped surface 61. In the preferred embodiment, each clutch wheel/tumbler comprises three locking fins 60. In addition, each clutch wheel/tumbler 25 also comprises an inside, circular shaped surface 62 which is axially aligned with outside surface 61. The diameter of inside surface 62 of clutch wheels/tumblers 25 is constructed to enable each clutch wheel/tumbler 25 to freely pivot about the outer surface of shaft/rod 24.

Furthermore, as shown in FIGS. 5, 10, and 11, each dial 26 is constructed for peripherally surrounding and cooperating with one clutch wheel/tumbler 25. In this regard, each dial 26 comprises two separate and distinct, circular shaped inside surfaces 63 and 64. Inside surface 63 comprises a diameter slightly greater than the diameter of outside surface 61 of clutch wheels/tumbler sleeve 25, in order to enable clutch wheels/tumbler 25 and dial 26 to cooperate with each other while being independently rotationally movable about shaft/rod 24.

In addition, each dial 26 comprises a plurality of slots 66 formed in inside surface 63 with each slot being constructed for receiving and retaining radially extending locking fin 60 of clutch wheel/tumbler 25. In this way, whenever radially extending locking fin 60 is mounted in a slot 66 of dial 26, clutch wheel/tumbler 25 and dial 26 are in interlocked engagement, causing both members to rotate together about shaft/rod 24.

The number of slots 66 formed in dial 26 correspond to the number of separate and distinct indicia formed on the outer surface of dial 26. In the preferred embodiment, ten indicia are employed on the outside surface of dial 26 and ten slots 66 are formed in surface 63.

Inside surface 64 of dial 26 comprises a circular shape formed by a diameter which is aligned with the axis of surface 63, but is greater than the length of locking fin 60. In this way, when locking fin 60 is disengaged from slot 66 of dial 26, dial 26 is able to rotate about shaft/rod 24 independently of clutch wheel/tumbler 25.

Each dial 26 has a plurality of indicia formed on the outer peripheral surface thereof, each of which represents one component of the combination for positioning clutch wheels/tumblers 25 in the requisite location for releasing shaft/rod 24 and enabling shaft/rod 24 to be axially movable within elongated, central bore 37. Although any desired indicia can be employed, numerals or letters are typically employed.

In the present invention, each dial 26 comprises an outer surface 67 on which ten panels 68 are formed with slots 69 separating each panel 68. In addition, one numeral ranging from 0, 1, 2, 3, 4, 5, 6, 7, 8, and 9, is formed on each panel 68. The numeral on each panel 68 of each dial 26 is then employed to define the combination for padlock 20.

In order to enable shaft/rod 24 to be axially movable in response to the preset combination being entered on panels 68 of dials 26, elongated central bore 37 incorporates at least one longitudinally extending slot or channel 75 formed therein and constructed for providing a release position for each locking fin 60 of clutch wheels/tumblers 25. In the preferred embodiment, elongated central bore 37 incorporates three longitudinally extending slots or channels 75 for enabling the three locking fins 60 of clutch wheels/tumblers 25 to be released. In this way, whenever the locking fins 60 of clutch wheels/tumblers 25 are aligned with release channels 75, shaft/rod 24 is capable of axial movement, thereby enabling shaft/rod 24 to be moved between its lock and unlocked positions, as well as being movable into the required position for enabling the combination of padlock 20 to be changed, set, or reset.

In the preferred construction, in addition to employing three separate and independent locking fins 60 on each clutch wheel/tumbler 25, the locking fins 60 are spaced apart from each other in a unique manner. By employing this unique construction, as well as the additional construction features detailed below, a high security, tamper-resistant padlock is realized, which virtually eliminates the likelihood of the padlock being opened by unauthorized individuals.

In one aspect of this preferred construction, the three locking fins 60 are not spaced apart from each other in equal arcuate distances. Instead, two of the arcuate distances separating the locking fins are equivalent, while the third arcuate distance between adjacent locking fins 60 is substantially different.

Although virtually any desired arcuate distances can be selected for positioning locking fins 60 on clutch wheel/tumbler 25, including having all three arcuate distances separate and distinct from each other, the present invention requires at least one of the arcuate spaced distances to be dissimilar from the other spaced arcuate distances, even if two of the arcuate spaced distances are equal. By employing this unique construction, substantial additional difficulty is created for any unauthorized individual attempting to determine the combination using known picking techniques.

In this regard, in order to enable shaft/rod 24 to be axially movable whenever the pre-set combination has been entered, housing 21 incorporates three release channels 75 formed along bore 37, with the release channels being arcuately spaced from each other with the same arcuate spacing employed for locking fins 60. In this way, when properly aligned, each locking fins 60 is aligned with one release channel 75 for enabling the movement of shaft/rod 24.

Since all three locking fins 60 must be aligned with all three release channels 75 before shaft/rod 24 can be axially moved, any individual using known picking techniques will have to resolve numerous false readings as one locking fin 60 becomes aligned with one release channel 75, while the other locking fins are not properly aligned. As a result, substantial increased difficulty will be encountered, virtually eliminating the ability of such an individual from being successful.

In addition, in order to provide a further theft deterrent feature in the present invention, one locking fin 60 is constructed with an overall length greater than the other locking fins of clutch wheel/tumbler 25. As shown in FIG. 14, locking fin 60A is depicted within an overall length which is a greater than the length of adjacent locking fins 60. In the preferred construction, locking fin 60A is constructed to extend on one side thereof a distance ranging between about 0.6 and 1.0 mm., with the optimum additional length being about 0.8 mm. This additional length portion is oriented to face release channels 75.

By employing this construction, a substantially increased theft deterrent feature is realized. In this regard, an unauthorized individual attempting to open padlock 20 of the present invention, using known picking techniques, would normally apply a force to pushbutton 81 while attempting to individually rotate dials 26. Using this technique, the entry of a locking fin into the release channels can be sensed. However, in the present invention, by constructing locking fin 60A with an overall length greater than the length of the adjacent locking fins, locking fin 60A will be the first locking fin to enter every release channel 75.

Unless the particular orientation of all of the locking fins 60 corresponds to the required orientation for enabling all three locking fins 60 to enter all three release channels 75, only locking fin 60A will enter a release channel 75, while the remaining locking fins 60 will merely hit up against the wall of housing 21. In addition, in this situation, any further attempt to rotate dial 26 will be thwarted, since locking fin 60A is engaged in one release channel 75.

As a result, the unauthorized individual will believe that the particular dial has been placed in the proper orientation and he will move on to the next dial in his continuing attempt to position each dial in the required orientation to open padlock 20. However, with each dial producing the same effect, this individual's ability to unlock padlock 20 without knowledge of the actual combination will be prevented and unwanted access to the locked items will be stopped.

In order to provide the desired locking and unlocking of padlock 20, in response to the entry of the preset combination on dials 26, cam member 27 is mounted to one end of shaft/rod 24. As depicted in this embodiment, cam member 27 comprises a cylindrically shaped, upper section 76 having a first diameter which is interconnected to cylindrically shaped lower section 77 which comprises a second diameter, with the second diameter being less than the first diameter of section 76. In addition, cam member 27 also comprises an arcuately curved intermediate or transition zone 78 which extends between and interconnects lower section 77 with upper section 76 and provides the required controlled camming movement of steel balls/bearings 28.

Finally, cam member 27 incorporates a centrally located aperture 79 F formed in upper section 76, which is constructed for retaining and positioning spring member 80, which is mounted and retained therein. As is further detailed below, spring member 80 is maintained under compression, for controlling the axial movement of shaft/rod 24 and continuously biasing shaft/rod 24 downwardly into its locked position.

In order to enable shaft/rod 24 to be controllably moved by the user for locking, and unlocking padlock 20, enlarged pushbutton 81 is mounted to the end of shaft/rod 24 which is opposite the end to which cam member 27 is mounted. By pressing pushbutton 81, the user is able to quickly and easily exert an upward force on pushbutton 81, causing shaft/rod 24 to move axially upwardly in elongated central bore 37, causing padlock 20 to open, whenever the preset combination has been entered on dials 26. In addition, in the preferred embodiment, enlarged pushbutton 81 is constructed and affixed to shaft/rod 24 in a manner which enables the user to grasp pushbutton 81 and axially move shaft/rod 24 downwardly, for placing clutch wheels/tumblers 25 in the required position to enable the combination of padlock 20 to be changed, when so desired by the user.

As the best seen in FIGS. 3 and 5, combination padlock 20 is normally maintained in the closed and locked position due to the biasing forces exerted by spring member 80 on cam member 27 and shaft/rod 24. As depicted, when combination padlock 20 is in this position, shackle 22 is secured to housing 21 due to the engagement of steel balls/bearings 28 in notched zones 50 and 51 of shackle 22. As shown, steel balls/bearings 28 are forced into locked engagement with notched zones 50 and 51 due to their contact with the outer surface of cylindrically shaped upper section 76. Due to the dimensional constructions employed, whenever cam member 27 is positioned with upper section 76 in contact with steel balls/bearings 28, steel balls/bearings 28 are forced outwardly into engagement with notched zones 50 and 51. Once in this position, shackle 22 is in secure, locked engagement in housing 21, incapable of movement relative to housing 21.

Furthermore, whenever dials 26 are rotationally moved about shaft/rod 24 into any position other than the position which specifically defines and displays the preset combination, shaft/rod 24 is incapable of being axially moved in elongated bore 37 due to the disengagement of locking fins 60 of clutch wheels/tumblers 25 from elongated slots/channels 75. As a result, whenever combination padlock 20 has been secured to any desired item and shackle 22 has been inserted into housing 21, steel balls/bearings 28 are forced into locked engagement with notched zones 50 and 51. Once in this position, dials 26 are free to rotate about shaft/rod 24 for causing combination padlock 20 to be in its locked position and retained in this position until the precisely desired preset combination has been reentered onto dials 26.

Whenever the preset combination has been properly entered on dials 26, shaft/rod 24 is capable of being axially moved in elongated central bore 37. When the user wishes to open padlock 20, the user merely exerts an upward force on pushbutton 81, causing shaft/rod 24 to axially move upwardly in the bore 37. This upward movement causes cam member 27 to move upwardly, against the spring force being exerted by spring member 80, while also causing arcuately curved camming transition zone 78 and smaller diameter lower section 77 to become aligned with steel balls/bearings 28.

Since the diameter of lower section 77 is substantially less than the diameter of upper section 76, steel balls/bearings 28 are now capable of horizontal movement relative to shackle 22. As a result, steel balls/bearings 28 are able to move out of engagement in notched zones 50 and 51, thereby enabling shackle 22 to axially move out of locked engagement with housing 21.

In the preferred construction, shackle control spring member 82 is mounted in elongated bore 40 in contact with terminating end 49 of long leg 48 of shackle 22. As a result, whenever lower section 77 of cam member 27 is aligned with steel balls/bearings 28, spring member 82 exerts an upward force on long leg 48 of shackle 22 causing shackle 22 to move axially upwardly relative to housing 21. This movement pushes steel balls/bearings 28 out of notched zones 50 and 51, into the open cavity or space established by lower section 77 of cam member 27. In this way, short leg 46 of shackle 22 is released from locked engagement in hole 42 of housing 21, with the release being immediately evident due to the forced axial movement of shackle 22 upwardly from housing 21.

Whenever shackle 22 is in its raised, open, unlocked position, one of the steel balls/bearings 28 is captured between the outer surface of long leg 48 of shackle 22 and intermediate zone 78 and lower section 77 of cam member 27. Although spring member 80 continues to exert a downward force on cam member 27, in an attempt to return shaft/rod 24 into its locked position, cam member 27 and shaft/rod 24 are maintained in this unlocked position, since the captured steel balls/bearings 28 are unable to move a sufficient distance which would allow larger diameter upper section 76 to move downwardly into the locked position. As result assurance is provided that padlock 20 remains in the unlocked position until shackle 22 is returned into housing 21, with notched zones 50 and 51 positioned in cooperating, aligned relationship with steel balls/bearings 28.

Whenever the user wishes to return padlock 20 into its locked mode, short leg 46 of shackle 22 is first aligned with receiving hole 42 of housing 21. Then, a downward force is exerted on shackle 22, causing short leg 46 to enter receiving hole 42, while long leg 48 is advanced into elongated bore 40. As the downward movement of shackle 22 continues, notched zones 50 and 51 are brought into alignment with steel balls/bearings 28. Once notched zones 50 and 51 are horizontally aligned with steel balls/bearings 28, the forces being exerted by spring member 80 on cam member 27 cause arcuately curved camming intermediate zone 78 to controllably guide steel balls/bearings 28 into engagement with notched zones 50 and 51, enabling cam member 27 and shaft/rod 24 to move downwardly, causing larger diameter, upper section 76 to be positioned between steel balls/bearings 28.

Once larger diameter upper section 76 is horizontally aligned with steel balls/bearings 28, steel balls/bearings 28 are forced into locked engagement with notched zones 50 and 51, securely engaging and maintaining shackle 22 in its locked position. In this way, padlock 20 is automatically returned into the locked position, for being maintained in this position with dials 26 being rotationally moved to eliminate the preset combination from being displayed.

As briefly mentioned above, any desired combination can be set on dials 26 by moving shaft/rod 24 into the combination reset position. Whenever this reset position is desired, pushbutton 81 is employed by the user for forcing shaft/rod 24 to move downwardly in central bore 37. This downward movement causes locking fins 60 of clutch wheels/tumblers 25 to be removed from slots 66 of dials 26, thereby allowing dials 26 to be rotated without causing clutch wheels/tumblers 25 to move simultaneously therewith. In this way, any desired indicia can be positioned into the display location or the combination defining location, thereby establishing any desired series of indicia for the desired combination.

In the preferred construction, a shaft/rod biasing spring 85 is mounted under compression between lock washer 86 and end plate 87. By employing biasing spring 85, a positive movement force is required to cause shaft/rod 24 to be moved into the combination reset position, preventing unwanted or accidental slippage of rod/shaft 24 into the combination reset position. In addition, although the force exerted by spring 85 upon shaft/rod 24 is in a direction opposite from the biasing force exerted by spring member 80 on cam member 27, the force produced by spring 85 is substantially less than spring member 80. In this way, spring 85 is incapable of interfering in any way with the principal biasing force exerted by spring member 80.

In addition, in the preferred construction, as shown in FIGS. 14, 15, and 16, pushbutton 81 incorporates an upstanding post 90 which is press-fit into a cavity formed in one end of shaft/rod 24. In this way, pushbutton 81 is constructed to provide the desired functions, while also being constructed to break away from shaft/rod 24 if excessive force is applied to pushbutton 81. As a result, any unauthorized person who attempts to forcibly unlock padlock 20 by pulling pushbutton 81 merely causes pushbutton 81 to disengage from shaft/rod 24, completely thwarting any attempt to forcibly unlock padlock 20 in this manner.

By referring to FIGS. 17–20, along with the following detailed discussion, the construction and operation of the second preferred embodiment of the present invention can best be understood. In this embodiment, padlock 20 incorporates two separate and distinct, alternate locking/unlocking systems, thereby achieving a dual mode padlock 20. In this alternate preferred embodiment, dual mode padlock 20 comprises a combination controlled locking section and a key controlled locking section, both of which operate independently to control the locking and the release of shackle 22 from housing 21.

In this embodiment, the principal components forming high security, dual mode padlock 20 comprise housing or body 21 and shackle 22, with housing 21 incorporating a combination controlled locking section 101 and a key controlled locking section 102. In the preferred construction of this embodiment of the present invention, the components required for forming and operating combination control locking section 101 are substantially identical to the components detailed above and shown in FIGS. 1–16.

As a result, the reference numerals employed in FIGS. 1–16 have been incorporated into FIGS. 17–20, in order to refer to substantially identical components. In addition, the detailed disclosure provided above in regard to these components is incorporated herein by reference, thereby avoiding any unnecessary repetition. However, it is to be understood that the foregoing detailed disclosure is equally applicable to the construction and operation of combination control locking section 101 in this embodiment of the present invention, with any different components and/or alternate constructions of these components being fully detailed below.

As shown in FIGS. 17–20, key controlled locking section 102 of padlock 20 incorporates cavity 105 formed in the front panel of housing 21 which is aligned and cooperates with cavity 106 formed the rear panel of housing 21. In addition, key controlled locking section 102 incorporates lock bearing housing 107 which is securely mounted and retained in cavities 105 and 106 of housing 21. In addition, lock bearing housing 107 securely retains and supports key operated cylinder 108, which is rotationally journalled in housing 107.

In the preferred construction, cylinder 108 is securely maintained in the desired position by fastening clip 109 which is constructed for maintaining cylinder 108 in position, while also enabling cylinder 108 to freely rotate within housing 107 when properly activated. In this regard, key 110 is employed for being inserted into cylinder 108 in order to attain the desired arcuate movement of cylinder 108 relative to housing 107. In addition, cylinder 108 incorporates two ridges or bosses 114 and 115 which are mounted to the rear surface of cylinder 108 and extend rearwardly therefrom. As is more fully detailed below, ridges 114 and 115 control the locking and unlocking of shackle 22 with housing 21.

Using a generally conventional construction, tumblers are mounted in cylinder 108 and housing 107 to prevent the arcuate or rotational movement of cylinder 108 relative to housing 107, unless all tumblers are properly positioned in a precise, predetermined aligned arrangement. When in the desired aligned position, cylinder 108 is capable of being articulately rotated.

In order to achieve the precisely desired aligned position for enabling cylinder 108 to be articulately rotated, key 110 is employed for placing each tumbler in the precisely desired predetermined position. In addition, key 110 provides the necessary leverage for enabling cylinder 108 to be articulately pivoted within the housing the 107. Once key 110 is inserted into the key receiving slot formed in cylinder 108, the tumblers are aligned in the precisely desired predetermined position, enabling cylinder 108 to be arcuately rotated.

In this embodiment of the present invention, cam member 27 incorporates slot 117 formed therein within which end 118 of shaft/rod 24 is slidingly mounted. In the preferred construction, slot 117 extends partly through cam member 27, thereby enabling shaft/rod 24 to be fully engaged within slot 117 in order to cause cam member 27 to move between the locked and unlocked positions, whenever shaft/rod 24 is axially movable due to the correct combination being displayed on dials 26.

Furthermore, in this embodiment, cam member 27 preferably comprises a substantially rectangular shape, with substantially flat upper side surfaces 120 and 121 formed thereon. As depicted, upper side surface 120 is positioned facing short leg 46, while upper side surface 121 is positioned facing long leg 48. In addition, cam member 27 also incorporates camming notched zones 122 and 123 formed therein, with notched zone 122 positioned directly below side surface 120, while notched zone 123 is positioned directly below side surface 121. In this way, as detailed below, this embodiment of cam member 27 achieves a virtually identical controlling operation over shackle locking members or steel balls/bearings 28 as detailed above in reference to the alternate embodiment.

In order to enable the arcuate movement of cylinder 108 to control the vertical movement of cam member 27, this embodiment of padlock 20 incorporates lever arm 125. As depicted, lever arm 125 incorporates finger portion 126 which extends from base 127. In addition, base 127 is positioned in abutting engagement with ledge 128 formed in a cutaway section of cam member 27.

In operation, as with the embodiment detailed above, padlock 20 is placed in the locked position by inserting shackle 22 into housing 21. In order to achieve the locked position, the combination control section 101 must have the correct combination displayed on dials 26, and key controlled locking section 102 must be placed in the locked position. Once these conditions are met, shackle 22 can be inserted into housing 21 with spring 80 continuously urging cam member 27 downwardly. Once notched zones 50 and 51 are moved into alignment with shackle locking members or steel balls/bearings 28, cam member 27 is forced downwardly, causing camming notched zones 122 and 123 to guidingly position steel ball/bearings 28 into notched zones 50 and 51 of shackle 22, enabling side surfaces 120 and 121 to be positioned between steel ball/bearings 28. Once this position is attained, padlock 20 is in the secure, locked position, as depicted in FIG. 19.

Figure 20:
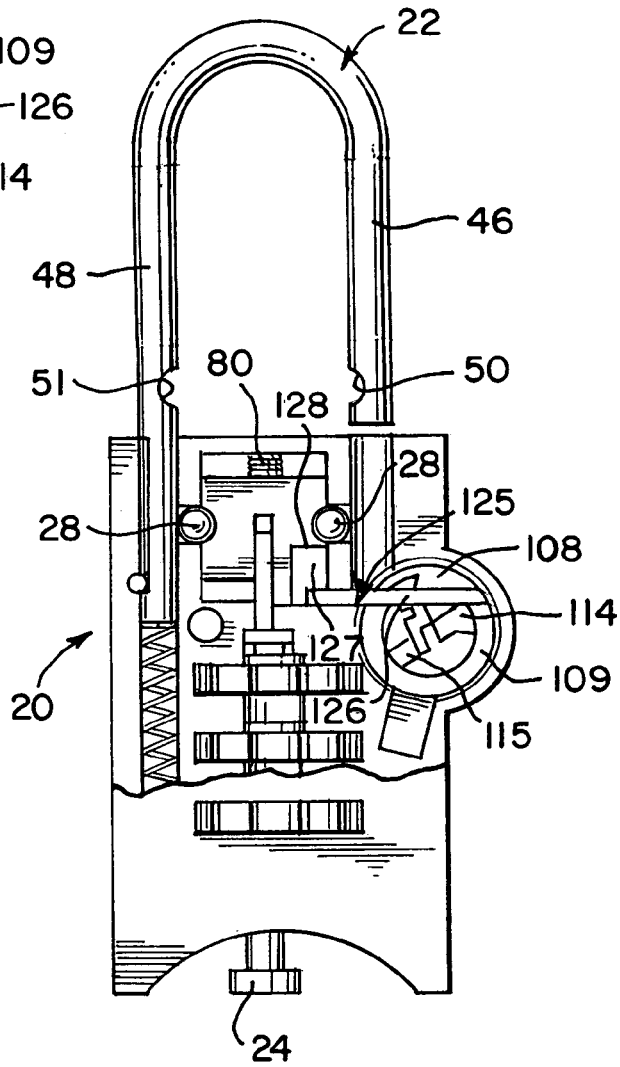
FIG. 20 is a rear elevation view of the dual locking mode padlock of FIG. 17 shown in the unlocked position, with the rear panel removed.

In order to unlock padlock 20, and attain the position shown in FIG. 20, either combination control locking section 101 or key controlled locking section 102 can be employed. As detailed above, the combination controlled locking section 101 can be employed by placing dials 26 in the predetermined orientation and axially moving shaft/rod 24 upwardly to move cam member 27 into the unlocked position. In this regard, all of the detailed explanation provided herein in regard to the first preferred embodiment is equally applicable to the operation of the second preferred embodiment. By performing these operations, the desired release of shackle 22 from housing 21 is attained.

In this embodiment, however, key controlled locking section 102 can also be employed to release shackle 22 from locked engagement with housing 21. In order to attain this result, key 110 is inserted in the key receiving slot of cylinder 105 and then arcuately pivoted in order to cause cylinder 108 to rotate within locked bearing housing 107. As shown in FIGS. 19 and 20, the arcuate movement of cylinder 108 between the locked position and the unlocked position causes ridges 1144 and 115 to arcuately pivot therewith.

Figure 19:
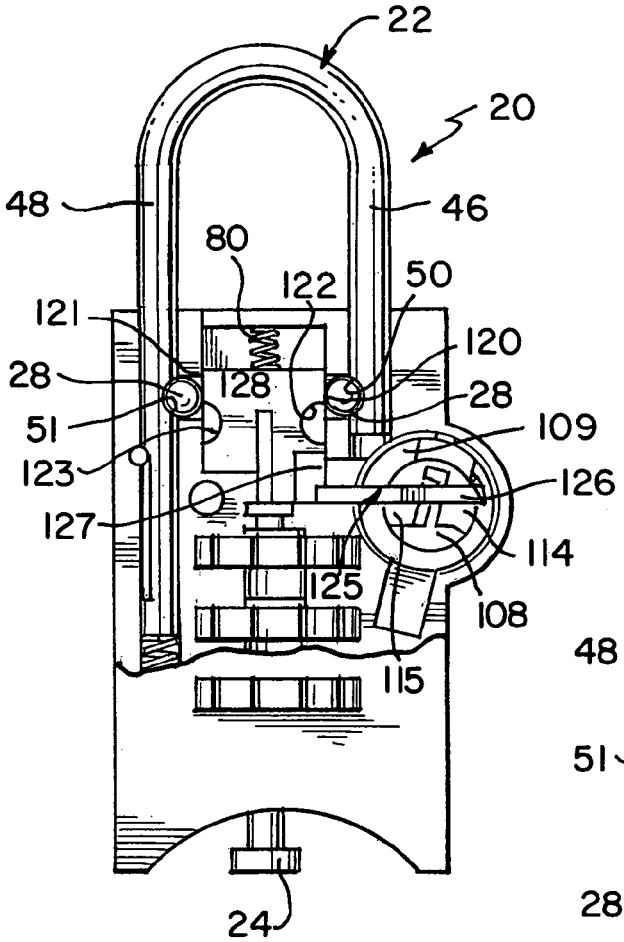
FIG. 19 is a rear elevation view of the dual locking mode padlock of FIG. 17 shown in the locked position, with the rear panel removed.

As clearly shown in FIGS. 19 and 20, finger portion 126 of lever arm 125 controllably rests on ridges 114 and 115. As a result, the arcuate movement of ridge 114 causes lever arm 125 to move upwardly as ridge 114 effectively moves upwardly. This upward movement causes base 127 of lever arm 125 to fully engage ledge 128 and move cam member 27 upwardly simultaneously therewith.

As cam member 27 moves upwardly, camming notched zones 122 and 123 become aligned with steel ball/bearings 28, enabling steel ball/bearings 28 to move from engagement with notched zones 50 and 51 of shackle 22 into notched zones 122 and 123 of cam member 27. Once steel ball/bearings 28 are disengaged from notched zones 50 and 51, shackle 22 is free to be released from engagement with housing 21.

As a result of the foregoing detailed discussion, it is apparent that this embodiment of the present invention provides an economically produced high security padlock 20 which provides two separate and independent locking modes. In addition, by employing either of the two separate locking modes, the precisely desired locking and unlocking of padlock 20 is realized, and a product is attained which is capable of resisting virtually all conventional techniques that may be used to gain unauthorized access to padlock 20.

As is evident from the foregoing detailed disclosure, the combination padlock of the present invention provides a uniquely constructed, high security, combination padlock which provides all the desired functions of a high security combination padlock in a highly effective, easily assembled, and easily employed construction. Furthermore, the present invention is capable of being produced with substantially greater ease and convenience, while also being easily employed by the user.

It will thus be seen that the object set forth above, among those made apparent from the preceding description, are efficiently attained and, since certain changes may be made in the above article without departing from the scope of this invention, it is intended that all matter contained in this disclosure or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A high security padlock constructed for ease-of-use as well as for substantially eliminating the ability of unauthorized persons from opening the padlock, said padlock comprising:

a housing incorporating a combination section incorporating a first, central elongated bore longitudinally extending through the center of the housing, and a second elongated bore formed in juxtaposed, spaced, substantially parallel relationship to the first central bore;

a plurality of dial receiving zones formed in the housing, each of said receiving zones extending substantially perpendicularly to the axis of the first central bore, and defined by two juxtaposed, spaced, parallel facing surfaces, each of said surfaces extending perpendicularly to the central axis of the central bore; and at least one elongated release channel formed in the first central bore and axially extending therewith, said elongated release channel defining a zone for enabling the opening of the padlock;

an elongated shaft mounted in the first central bore and constructed for axial, longitudinal movement therein, said shaft comprising a first end and a second end;

a shackle comprising a generally J-shape, incorporating a short leg having a terminating end constructed for cooperative locking and unlocking engagement with the housing, and also incorporating a notched zone formed in said short leg adjacent to the terminating end, and a long leg cooperatively mounted in the second elongated bore of the housing for axial movement and pivoting movement relative thereto, and incorporating a notched zone formed therein and positioned in cooperating alignment with the notched zone of the short leg;

a plurality of tumbler sleeves, each of said tumbler sleeves being rotationally mounted to the elongated shaft for rotational movement about the central axis thereof, and incorporating at least one radially extending fin formed on the outside surface thereof and constructed for cooperative association with at least one of the elongated release channels for preventing axial movement of the shaft as well as enabling the axial movement thereof when each of said radial fins are positioned in one of the elongated release channels;

a plurality of dials, each of said dials mounted in a dial receiving zone of the housing, peripherally surrounding a tumbler sleeve for cooperating therewith; and two shackle locking members mounted in the housing in cooperating relationship with the notched zones of the shackle; and a cam member mounted to the first terminating end of the shaft and positioned in cooperating relationship with the notched zones of the shackle and the shackle locking members for controllably guiding and moving the locking members between a first locked position wherein a portion of each locking member is engaged in one notched zone of the shackle, and a second unlocked position wherein the locking members are disengaged from the notched.

2. The high security padlock defined in claim 1, wherein said cam member is further defined as comprising a first portion and a second portion positioned in cooperating relationship with each other and positioned for being alternately movable into alignment with the notched zones of the shackle and controlling engagement with the shackle locking members for controlling the movement of the locking members between the padlock locked position and the padlock unlocked position.

3. The high security padlock defined in claim 2, wherein the locking members are further defined as comprising spherically shaped balls or bearings and the cam member is further defined as comprising a first dimension defined by the first portion and a second dimension defined by the second portion, the second dimension being less than the first dimension for enabling the spherically shaped balls/bearings to be easily moved out of locking engagement with the notched zones of the shackle.

4. The high security padlock defined in claim 3, wherein the cam member is further defined as being axially movable within the housing of the padlock between a first position and a second position, said first position being the locked mode wherein the first portion of the cam member is aligned with the locking members and the notched zones of the shackle for causing at least a portion of the locking members to be maintained in engagement within the notched zones, thereby preventing movement of the shackle relative to the housing; and said second position being the unlocked mode wherein the second portion of the cam member is aligned with the locking members and the notched zones of the shackle for enabling the locking members to be disengaged from the notched zones, thereby releasing the shackle locked engagement in the housing.

5. The high security padlock defined in claim 4, wherein the cam member is further defined as comprising a camming or guiding surface formed between the first portion and the second portion for controllably contacting and guiding the movement of the spherically balls/bearings into and out of engagement with the notched zones of the shackle.

6. The high security padlock defined in claim 1, wherein the first central elongated bore is further defined as being closed at the top surface of the housing and open at the bottom end of the housing, and the elongated shaft mounted therein is further defined as comprising a finger operable pushbutton affixed to the second end thereof for controlling the axial movement of the shaft within the elongated bore.

7. The high security padlock defined in claim 6, wherein said pushbutton is further defined as being mounted to the shaft with a breakaway engagement for theft deterrent purposes.

8. The high security padlock defined in claim 1, wherein said padlock further comprises a biasing spring mounted between the housing and the cam member for continuously biasing the cam member and the elongated shaft associated therewith downwardly, thereby maintaining the padlock in its normally locked position with a first portion of the cam member aligned with the locking members and the notched zones of the shackle.

9. The high security padlock defined in claim 1, wherein each of said tumbler sleeves are further defined as comprising three separate and independent radially extending fins formed on the outside surface thereof and said housing is further defined as comprising three separate and independent elongated release channels formed along the length of the first central bore and constructed for cooperating with the radially extending fins of the tumbler sleeves for enabling the opening of the padlock.

10. The high security padlock defined in claim 9, wherein the arcuate spaced distance between the three radially extending fins of the tumbler sleeves are constructed with at least one of said arcuate distances being greater than the remaining two arcuate distances and the arcuate distance between the three release channels are constructed with identical dimensions, thereby providing a construction which provides an added theft deterrent feature.

11. The high security padlock defined in claim 10, wherein the length of one of said radially extending fins is further defined as being greater than the length of the other two radially extending fins, thereby providing a construction wherein the radially extending fin with the greater length engages one of the release channels before the remaining two radially extending fins engage a release channel, thereby providing a construction which achieves an additional theft deterrent feature while still enabling the normal operation of the padlock to be unaffected.

12. The high security padlock defined in claim 1, wherein said padlock further comprises a key controlled locking section constructed for enabling the locking and unlocking of the shackle completely independently of the combination controlled section, thereby achieving a padlock construction comprising two separate and independent locking/unlocking control modes.

13. The high security padlock defined in claim 12, wherein the key controlled locking section is further defined as comprising:

a cylinder mounted in the housing for controlled rotational movement and incorporating a key receiving slot cooperatively associated with a plurality of tumblers for preventing the rotational movement of said cylinder whenever the designated key member is not present and enabling the rotational movement of the cylinder in response to activation by the designated key member, and a ridge portion formed on the rear surface of the cylinder and constructed for extending outwardly therefrom; and a lever arm extending between the cylinder and the cam member and constructed for moving the cam member between the first locked position and the second unlocked position in response to controlled movement thereof by the arcuate movement of the ridge portion of the cylinder;

whereby the rotational movement of the cylinder in response to the activation by the designated key member causes the ridge portion to arcuately move and simultaneously move the lever arm for causing the cam member to move from its first locked position to its second unlocked position.

14. The high security padlock defined in claim 13, wherein said lever arm is further defined as being in nested, contacting engagement with a surface of the cam member for assuring controlled movement of the cam member in response to the arcuate movement of the cylinder and the ridge portion mounted thereto.

15. A high security dual locking mode padlock constructed for ease-of-use as well as for substantially eliminating the ability of unauthorized persons from opening the padlock, said padlock comprising:

a housing incorporating a combination controlled section and a key controlled section, comprising a first, central elongated bore longitudinally extending through the center of the housing, a second elongated bore formed in juxtaposed, spaced, substantially parallel relationship to the first central bore; and a cavity for receiving and retaining the key controlled section;

a plurality of dial receiving zones formed in the housing, each of said receiving zones extending substantially perpendicularly to the axis of the first central bore, and defined by two juxtaposed, spaced, parallel facing surfaces, each of said surfaces extending perpendicularly to the central axis of the central bore; and at least one elongated release channel formed in the first central bore and axially extending therewith, said elongated release channel defining a zone for enabling the opening of the padlock;

an elongated shaft mounted in the first central bore and constructed for axial, longitudinal movement therein, said shaft comprising a first end and a second end;

a shackle comprising a generally J-shape, incorporating a short leg having a terminating end constructed for cooperative locking and unlocking engagement with the housing, and also incorporating a notched zone formed in said shaft leg adjacent to the terminating end, and a long leg cooperatively mounted in the second elongated bore of the housing for axial movement and pivoting movement relative thereto, and incorporating a notched zone formed therein and positioned in cooperating alignment with the notched zone of the short leg;

a plurality of tumbler sleeves, each of said tumbler sleeves being rotationally mounted to the elongated shaft for rotational movement about the central axis thereof, and incorporating at least one radially extending fin formed on the outside surface thereof and constructed for cooperative association with at least one of the elongated release channels for preventing axial movement of the shaft as well as enabling the axial movement thereof when each of said radial fins are positioned in one of the elongated release channels;

a plurality of dials, each of said dials mounted in a dial receiving zone of the housing, peripherally surrounding a tumbler sleeve for cooperating therewith;

a cylinder mounted in a receiving and retaining cavity of the housing for controlled rotational movement and incorporating a key receiving slot cooperatively associated with a plurality of tumblers for preventing the rotational movement of said cylinder whenever the designated key member is not present and enabling the rotational movement of the cylinder in response to activation by the designated key member, a ridge portion formed on the rear surface of the cylinder and constructed for extending outwardly therefrom;

two shackle locking members mounted in the housing in cooperating relationship with the notched zones of the shackle;

a cam member mounted to the first terminating end of the shaft and positioned in cooperating relationship with the notched zones of the shackle and the shackle locking members for controllably guiding and moving the locking members between a first locked position wherein a portion of each locking member is engaged in one notched zone of the shackle, and a second unlocked position wherein the locking members are disengaged from the notched zones of the shackle; and a lever arm extending between the cylinder and the cam member and constructed for moving the cam member between the first locked position and the second unlocked position in response to controlled movement thereof by the arcuate movement of the ridge portion of the cylinder, thereby enabling the rotational movement of the cylinder in response to the activation by the designated key member to causes the ridge portion to arcuately move and simultaneously move the lever arm for causing the cam member to move from its first locked position to its second unlocked position.

16. The high security padlock defined in claim 15, wherein said lever arm is further defined as being in nested, contacting engagement with a surface of the cam member for assuring controlled movement of the cam member in response to the arcuate movement of the cylinder and the ridge portion mounted thereto.

17. The high security padlock defined in claim 15, wherein said cam member is further defined as comprising a first portion and a second portion positioned in cooperating relationship with each other and positioned for being alternately movable into alignment with the notched zones of the shackle and controlling engagement with the shackle locking members for controlling the movement of the locking members between the padlock locked position and the padlock unlocked position.

18. The high security padlock defined in claim 17, wherein the locking members are further defined as comprising spherically shaped balls or bearings and the cam member is further defined as comprising a first dimension defined by the first portion and a second dimension defined by the second portion, the second dimension being less than the first dimension for enabling the spherically shaped balls/bearings to be easily moved out of locking engagement with the notched zones of the shackle.

19. The high security padlock defined in claim 18, wherein the cam member is further defined as being axially movable within the housing of the padlock between a first position and a second position, said first position being the locked mode wherein the first portion of the cam member is aligned with the locking members and the notched zones of the shackle for causing at least a portion of the locking members to be maintained in engagement within the notched zones, thereby preventing movement of the shackle relative to the housing; and said second position being the unlocked mode wherein the second portion of the cam member is aligned with the locking members and the notched zones of the shackle for enabling the locking members to be disengaged from the notched zones, thereby releasing the shackle locked engagement in the housing.

20. The high security padlock defined in claim 19, wherein the cam member is further defined as comprising a camming or guiding surface formed between the first portion and the second portion for controllably contacting and guiding the movement of the spherically balls/bearings into and out of engagement with the notched zones of the shackle.

* * * * *